US011223888B2

(12) United States Patent
Peng

(10) Patent No.: US 11,223,888 B2
(45) Date of Patent: Jan. 11, 2022

(54) BONE CONDUCTION SPEAKER COMPOSED OF DOUBLE MAGNETIC FIELDS

(71) Applicant: Shenzhen Yuyuantong Technology Co., Ltd., Guangdong (CN)

(72) Inventor: Hailong Peng, Shenzhen (CN)

(73) Assignee: Shenzhen Yuyuantong Technology Co., Ltd.

( * ) Notice: Subject to any disclaimer, the term of this patent is extended or adjusted under 35 U.S.C. 154(b) by 0 days.

(21) Appl. No.: 17/099,777

(22) Filed: Nov. 16, 2020

(65) Prior Publication Data

US 2021/0152909 A1 May 20, 2021

(30) Foreign Application Priority Data

Nov. 15, 2019 (CN) ..... 201921987599.7

(51) Int. Cl.
*H04R 25/00* (2006.01)
*H04R 1/10* (2006.01)

(52) U.S. Cl.
CPC ..... *H04R 1/10* (2013.01); *H04R 2460/13* (2013.01)

(58) Field of Classification Search
CPC ..... H04R 9/027; H04R 1/00; H04R 9/025; H04R 9/047; H04R 9/045; H04R 9/043; H04R 3/002; H04R 9/046; H04R 9/063; H04R 7/06
See application file for complete search history.

(56) References Cited

U.S. PATENT DOCUMENTS

2010/0177927 A1* 7/2010 Sano ..... H04R 31/00 381/400

* cited by examiner

*Primary Examiner* — Amir H Etesam
(74) *Attorney, Agent, or Firm* — Timothy T. Wang; Ni, Wang & Massand, PLLC

(57) ABSTRACT

The utility model discloses a bone conduction speaker composed of double magnetic fields, which comprises a mechanical conductive sheet, a conduction shell, an outer housing, a coil and a magnetic assembly, wherein the conduction shell comprises a bottom plate and a side wall, and the magnetic assembly comprises a first magnet, a magnetic conductive sheet and a second magnet; the side wall of the conduction shell surrounds the first magnet, the magnetic conductive sheet and the second magnet; and the coil is arranged in a magnetic gap formed between the side wall of the conduction shell and the magnetic assembly. The second magnet can inhibit leakage of magnetic induction field generated by the first magnet, restrain the form of magnetic induction lines passing through the coil, make more of the magnetic induction field pass through the coil as horizontally and densely as possible, and enhance the magnetic induction sensitivity at the coil position. In addition, a magnetic induction field generated by a magnetic field of the second magnet can further enhance the magnetic induction strength at the magnetic field position (i.e., at the magnetic gap), thereby improving the sensitivity of the bone conduction speaker and further improving the mechanical conversion efficiency of the bone conduction speaker.

9 Claims, 1 Drawing Sheet

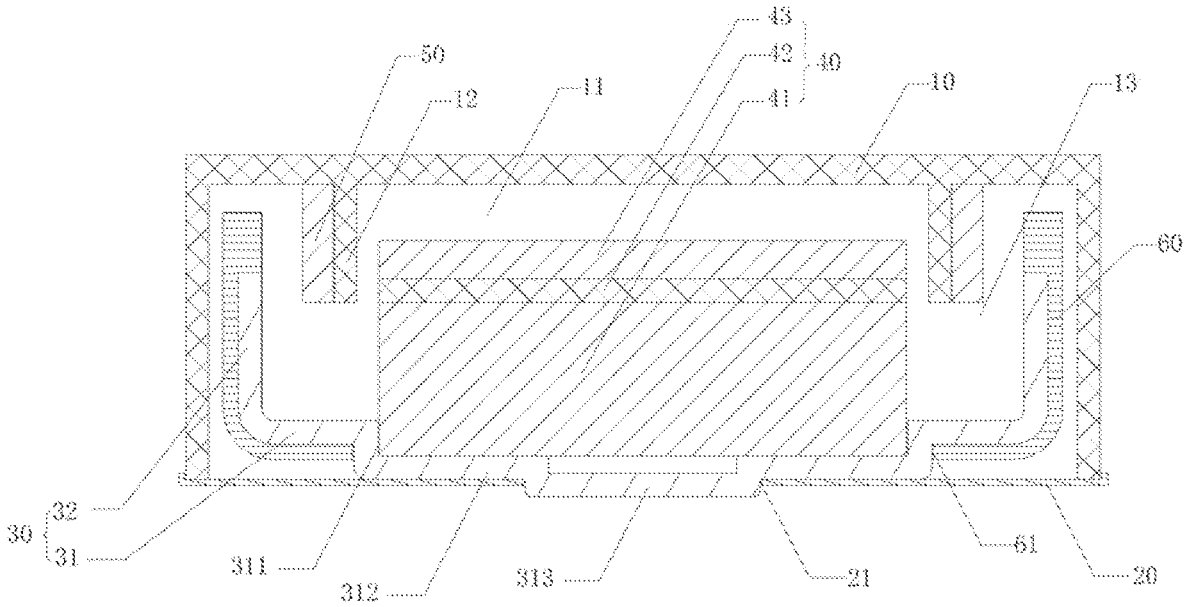
43
42
40
41
50
12
11
10
13
60
32
30
31
311
312
313
21
61
20

BONE CONDUCTION SPEAKER COMPOSED OF DOUBLE MAGNETIC FIELDS

FIELD OF THE INVENTION

The utility model relates to a bone conduction speaker, in particular to a bone conduction speaker composed of double magnetic fields.

BACKGROUND OF THE INVENTION

Bone conduction is a sound conduction mode, which converts sound into mechanical vibration with different frequencies, and transmits sound waves through a human skull, a bone labyrinth, internal ear lymph fluid, a Corti, an auditory nerve to an auditory center.

Bone conduction speaker can convert electrical signals into mechanical vibration signals, and transmit the vibration signals into cochlea through human tissues and bones, so that users can hear the sound. Compared with air conduction speakers, which drive air to vibrate in order to produce sound through diaphragms, bone conduction vibration speakers need to drive soft tissues and bones of a user to vibrate, so it needs higher mechanical power. Improving the sensitivity of bone conduction speakers can make the efficiency of converting electrical energy into mechanical energy higher, and thus output more mechanical power.

However, the existing bone conduction speakers generally have only one magnet. For a bone conduction speaker with a single magnetic element, magnetic induction lines passing through a coil is uneven and divergent, and magnetic leakage may occur in a magnetic circuit, that is, more of magnetic induction field leak out of a magnetic gap and fail to pass through the coil, thus reducing the magnetic induction strength (or magnetic field strength) at the coil position and affecting the sensitivity of bone conduction speakers.

SUMMARY OF THE INVENTION

The technical problem to be solved by the utility model is to provide a bone conduction speaker composed of double magnetic fields with high sensitivity. To solve the above technical problems, the utility model adopts the following technical solution:

A bone conduction speaker composed of double magnetic fields comprises a mechanical conductive sheet, a conduction shell, an outer housing, a coil and a magnetic assembly, wherein the mechanical conductive sheet and the outer housing are connected to form an accommodation space for the conduction shell, the coil and the magnetic assembly; the conduction shell comprises a bottom plate and a side wall formed by an extension of an edge of the bottom plate in a direction perpendicular to the bottom plate. The magnetic assembly comprises a first magnet, a magnetic conductive sheet and a second magnet, which are sequentially connected from bottom to top. The side wall of the conductive shell surrounds the first magnet, the magnetic conductive sheet and the second magnet; and the coil is arranged in a magnetic gap formed between the side wall of the conductive shell and the magnetic assembly and is fixedly connected with the outer housing The utility model has the beneficial technical effects that the above-mentioned bone conduction speaker composed of dual magnetic fields comprises two magnets, namely, a first magnet and a second magnet; On one hand, the second magnet can inhibit the leakage of magnetic induction field generated by the first magnet, and restrain the form of magnetic induction lines passing through the coil, so that more of magnetic induction field can pass through the coil as horizontally and densely as possible, thus enhancing the magnetic induction strength at the coil position; on the other hand, the magnetic induction field generated by the magnetic field of the second magnet itself can further enhance the magnetic induction field at the coil position (i.e., at the magnetic gap)

BRIEF DESCRIPTION OF THE DRAWINGS

FIG. 1 is a sectional view of a bone conduction speaker composed of dual magnetic fields.

DETAILED DESCRIPTION OF THE INVENTION

In order to make those of ordinarily skill in the art understand the purpose, technical solution and advantages of the utility model more clearly, the utility model will be further explained with reference to the attached drawings and embodiments.

As shown in FIG. 1, in one embodiment of the utility model, a bone conduction speaker composed of dual magnetic fields comprises a mechanical conductive sheet 20, a conduction shell 30, an outer housing 10, a coil 50 and a magnetic assembly 40, wherein the mechanical conductive sheet 20 and the outer housing 10 are connected to form an accommodation space 11 for the conduction shell 20, the coil 5 and the magnetic assembly 40. The mechanical conductive sheet 20 and the outer housing 10 can be integrally connected in a certain way, and the connection way can include any one of bonding, clamping, welding, riveting, bolting and the like or the combination thereof.

The conductive shell 30 includes a bottom plate 31 and a side wall 32 formed by an extension of an edge of the bottom plate in a direction perpendicular to the bottom plate 31. The magnetic assembly 40 includes a first magnet 41, a magnetic conductive sheet 42 and a second magnet 43 which are sequentially connected from bottom to top. The first magnet 41 and the second magnet 43 are magnets made of alloy permanent magnet materials including but not limited to NdFeB, SmCo, AlNiCo, FeCrCo, Al—Fe—B, Fe—C—Al, and ferrite permanent magnet materials including but not limited to barium ferrite, steel ferrite, manganese ferrite and lithium manganese ferrite. The conductive shell 30 and the magnetic conductive sheet 42 are made of soft magnetic materials such as silicon steel sheet, ferrite or iron and the like. The mechanical conductive sheet 20 is connected with a lower surface of the bottom plate 31 of the conductive shell 30, and a lower surface of the first magnet 41 is connected with an upper surface of the bottom plate 31 of the conductive shell 30. The connection mode can include any one of bonding, clamping, welding, riveting, bolting and the like, or the combination thereof.

The side wall 32 of the conductive shell 30 surrounds the magnetic assembly 40, that is, the side wall 32 of the conductive shell 30 surrounds the first magnet 41, the magnetic conductive sheet 42 and the second magnet 43. A magnetic gap 13 is formed between the side wall 32 of the conductive shell 30 and the magnetic assembly 40, and the coil 50 is arranged in the magnetic gap 13 and fixedly connected with the outer housing 10.

The first magnet 41, the magnetic conductive sheet 42, the second magnet 43, the bottom plate 31 and the side wall 32 can form a magnetic circuit. When current is introduced into the coil 50, the magnetic system composed of the first magnet 41, the magnetic conductive sheet 42, the second magnet 43 and the conductive shell 30 generates current induction, which changes magnetic field strength, inductance and other parameters of the magnetic system, and the coil 50 is subjected to Ampere force in the magnetic field, so that the coil 50 is reciprocated longitudinally relative to the magnetic system. As the coil 50 is fixedly connected with the outer housing 10 so that the magnetic system composed of the first magnet 41, the magnetic conductive sheet 42, the second magnet 43 and the conductive shell 30 is reciprocated longitudinally, the mechanical conductive sheet 20 is driven to vibrate by the conductive shell 30, and the mechanical conductive sheet 20 directly contacts a human body to transmit sound vibration to human bones, so that a person can sense sound through bone conduction.

The bone conduction speaker composed of double magnetic fields of the utility model, comprises a first magnet 41, a magnetic conductive sheet 42 and a second magnet 43. On one hand, the second magnet 43 can inhibit leakage of magnetic induction lines generated by the first magnet 41 and restrain the form of magnetic induction lines passing through the coil 50, so that more magnetic induction lines pass through the coil 50 as horizontally and densely as possible, enhancing the magnetic induction strength at the position of the coil 50; on the other hand, since the magnetic induction lines are generated by the second magnet 43's own magnetic field, the magnetic induction strength at the position of the coil 50 (i.e., at the magnetic gap 13) can be further enhanced, thereby improving the sensitivity of the bone conduction speaker and further improving the mechanical conversion efficiency of the bone conduction speaker. In addition, the first magnet 41, the magnetic conductive sheet 42 and the second magnet 43 are sequentially connected from bottom to top, so that the volume and weight of the magnetic circuit assembly can be reduced, thereby reducing the volume and weight of the bone conduction speaker with improved magnetic field strength of the magnetic gap and improved sensitivity of the bone conduction speaker.

The first magnet 41 and the second magnet 43 can have different structures, such as an annular structure or a columnar structure. In this embodiment, the first magnet 41 and the second magnet 43 are preferably cylindrical structures.

The first magnet 41 and the second magnet 43 have the same magnetization direction, which refers to the magnetic field directions inside the first magnet 41 and the second magnet 43.

The outer side of the conductive shell 30 is covered with a silicone sleeve 60. The silicone sleeve 60 can protect the magnetic system of the bone conduction speaker from external interference and reduce the generation of noise. The silicone sleeve 60 can also prevent magnetic echo caused by magnetic leakage and magnetic loss of the bone conduction speaker which affects the sound quality. The silicone sleeve 60 can also reduce the noise caused by friction between the conductive shell 30 and the outer housing 10 due to vibration deviation of the conductive shell 30, thereby improving the sound quality. A lower surface of the bottom plate 31 of the conductive shell 30 is provided with a first positioning bump 312, and the silicone sleeve 60 is provided with a first positioning hole 61 matched with the first positioning bump 312. The silicone sleeve 60 and the conductive shell 30 are connected and fixed by the first positioning bump 312 and the first positioning hole 61, so that the connection is more stable and the sound quality is more stable.

An upper surface of the bottom plate 31 of the conductive shell 30 is provided with a positioning groove 311, and the first magnet 41 is fixedly connected with the bottom plate 31 after being placed in the positioning groove 311. By adopting this connection mode, fault-tolerant noise caused by a plane matching connection can be prevented, so that the connection is more stable and the sound quality is more stable.

A center of a surface of the first positioning bump 312 is provided with a second positioning bump 313, and the mechanical conductive sheet 20 is provided with a second positioning hole 21 matched with the second positioning bump 313. The mechanical conductive sheet 20 and the conductive shell 30 are fixedly connected by laser welding through the matching positioning of the second positioning bump 313 and the second positioning hole 21. By adopting this connection mode, the fault-tolerant noise caused by the plane matching connection can be prevented, so that the connection is more stable and the sound quality is more stable.

The outer housing 10 is provided with a coil fixing collar 12, and the coil 50 is first sleeved over the outer wall of the coil fixing collar 12, and then the coil 50 and the coil fixing collar 12 are fixed by bonding, clamping or welding, etc. By adopting this connection mode, the connection can be made more stable, thus making the sound quality more stable.

The above is only a preferred embodiment of the utility model, and does not limit the utility model in any form. Those of ordinary skill in the art can apply various equivalent variations and improvements on the basis of the above embodiments, and all equivalent variations or modifications made within the scope of claims shall fall within the scope of protection of the utility model.

What is claimed is:

1. A bone conduction speaker composed of dual magnetic fields, characterized in that the bone conduction speaker composed of dual magnetic fields comprising:

a mechanical conductive sheet, a conduction shell, an outer housing, a coil and a magnetic assembly, wherein the mechanical conductive sheet and the outer housing are connected to form an accommodation space for the conduction shell, the coil and the magnetic assembly;

the conduction shell comprises a bottom plate and a side wall formed by an extension of an edge of the bottom plate in a direction perpendicular to the bottom plate;

the magnetic assembly comprises a first magnet, a magnetic conductive sheet and a second magnet;

the bottom plate, the first magnet, the magnetic conductive sheet and the second magnet are sequentially connected from bottom to top; the side wall of the conductive shell surrounds the first magnet, the magnetic conductive sheet and the second magnet; and the coil is arranged in a magnetic gap formed between the side wall of the conductive shell and the magnetic assembly and is fixedly connected with the outer housing.

2. The bone conduction speaker composed of double magnetic fields according to claim 1, characterized in that the outer side of the conduction shell is covered with a silicone sleeve.

3. The bone conduction speaker composed of dual magnetic fields according to claim 1, characterized in that an upper surface of the bottom plate is provided with a positioning groove, and the first magnet is placed in the positioning groove.

4. The bone conduction speaker composed of dual magnetic fields according to claim 2, characterized in that a lower surface of the bottom plate is provided with a first positioning bump, and the silicone sleeve is provided with a first positioning hole matched with the first positioning bump.

5. The bone conduction speaker composed of double magnetic fields according to claim 4, characterized in that a second positioning bump is arranged at the center of the surface of the first positioning bump, and the mechanical conductive sheet is provided with a second positioning hole matched with the second positioning bump.

6. The bone conduction speaker composed of double magnetic fields according to claim 1, characterized in that the outer housing is provided with a coil fixing collar, and the coil is sleeved over the coil fixing collar.

7. The bone conduction speaker composed of dual magnetic fields according to claim 1, characterized in that the first magnet and the second magnet are both permanent magnets.

8. The bone conduction speaker composed of dual magnetic fields according to claim 7, characterized in that magnetization directions of the first magnet and the second magnet are consistent.

9. The bone conduction speaker composed of dual magnetic fields according to claim 7, wherein the first magnet and the second magnet are both cylindrical structures and the bone conduction speaker composed of double magnetic fields according to claim 1, characterized in that the mechanical conductive sheet and the conduction shell are fixed by laser welding.

* * * * *